US007748897B2

(12) United States Patent
Bache et al.

(10) Patent No.: US 7,748,897 B2
(45) Date of Patent: Jul. 6, 2010

(54) METHOD FOR MONITORING A TEMPERATURE-DEPENDENT RESISTOR, PARTICULARLY IN A CLOTHES DRYER

(75) Inventors: Kai-Uwe Bache, Berlin (DE); Thomas Nawrot, Berlin (DE); Ulrich Nehring, Berlin (DE); Andreas Ziemann, Potsdam (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 288 days.

(21) Appl. No.: 11/918,599

(22) PCT Filed: Feb. 8, 2006

(86) PCT No.: PCT/EP2006/050775

§ 371 (c)(1),
(2), (4) Date: Oct. 15, 2007

(87) PCT Pub. No.: WO2006/114340

PCT Pub. Date: Nov. 2, 2006

(65) Prior Publication Data

US 2009/0028214 A1 Jan. 29, 2009

(30) Foreign Application Priority Data

Apr. 27, 2005 (DE) ..... 10 2005 019 588

(51) Int. Cl.

| | |
|---|---|
| ***G01K 7/00*** | (2006.01) |
| ***G01K 15/00*** | (2006.01) |
| ***G01K 13/00*** | (2006.01) |
| ***G01K 3/00*** | (2006.01) |

(52) U.S. Cl. ..... 374/185; 374/1; 374/101; 374/141; 374/102; 374/148

(58) Field of Classification Search ..... 374/141, 374/185, 101, 1, 148, 102
See application file for complete search history.

(56) References Cited

U.S. PATENT DOCUMENTS 5,235,527 A 8/1993 Ogawa et al.

(Continued)

FOREIGN PATENT DOCUMENTS

DE 197 04 213 9/1998

(Continued)

OTHER PUBLICATIONS

International Search Report PCT/EP2006/050775.

*Primary Examiner*—Gail Verbitsky
*Assistant Examiner*—Mirellys Jagan
(74) *Attorney, Agent, or Firm*—James E. Howard; Andre Pallapies

(57) ABSTRACT

A method for monitoring the proper functioning of a temperature-dependent resistor, particularly a NTC resistor, for measuring the temperature of a medium heated by a heat source. Said medium is preferably the air flow in a clothes dryer for drying clothes. In order to increase the safety of a device, in particular a clothes dryer, where the temperature-dependent resistor is used in combination with a heat source, it is checked, once the heat source is switched on, whether the temperature measured by the resistor after a first predetermined period of time following the switching on of the heat source falls below a predetermined temperature threshold value. If this is the case, monitoring of a resistor-temperature curve characteristic of the temperature-dependent resistor is carried out.

14 Claims, 2 Drawing Sheets

U.S. PATENT DOCUMENTS 5,347,727 A * 9/1994 Kim ..... 34/491
5,564,831 A * 10/1996 Bashark ..... 374/141
5,764,542 A * 6/1998 Gaudette et al. ..... 702/179

FOREIGN PATENT DOCUMENTS

DE 199 58 384 6/2001
DE 101 56 037 6/2003
DE 103 29 038 2/2005
EP 1 363 114 11/2003
EP 1 385 073 1/2004

* cited by examiner

METHOD FOR MONITORING A TEMPERATURE-DEPENDENT RESISTOR, PARTICULARLY IN A CLOTHES DRYER

BACKGROUND OF THE INVENTION

The invention relates to a method for monitoring a temperature-dependent resistor, especially a negative temperature coefficient (NTC) resistor for measuring the temperature in the vicinity of a heat source. The heat source involved is preferably a heater for warming up an air flow in a clothes dryer. In addition the invention relates to a method for operating such a clothes dryer as well as to a clothes dryer itself for executing the method.

The use of NTCs in clothes dryers is known for monitoring temperatures in the clothes dryers. The signals of the NTCs are detected and evaluated in a controller typically embodied as a microcontroller and converted into temperatures which then serve as a basis for the control of the clothes dryer. The NTCs are therefore of major significance for the safety of the clothes dryer and are monitored continuously for broken cables and/or short circuit.

Using this prior art is its starting point, the underlying object of the invention is to develop a known method for monitoring a temperature-dependent resistor as well as a method for operating a clothes dryer, as well as a known clothes dryer to execute the two methods in such a manner that the safety of a device with a heat source and a temperature-dependent resistor, especially of a clothes dryer, is further increased.

BRIEF SUMMARY OF THE INVENTION

This object is achieved by the method claimed in claim 1. This method is characterized by the following steps:

Switching on the heat source;

Checking whether the temperature measured by the temperature-dependent resistor after a first predetermined period of time after the heat source has been switched on falls below a predetermined temperature threshold value and If it does: Monitoring the functional integrity of the resistor or If it does not: Not undertaking any monitoring of the resistor.

The first prespecified period will expediently be suitably selected as a function of the heat output of the heat sources, of the respective ambient temperature and of the level of the prespecified temperature threshold value. Basically it can also amount to zero seconds; the current temperature in the vicinity of the heat source accords with the temperature value at the time of switching-on the heat source.

Advantageously a possible change in its behavior or of its characteristic curve over the course of time is recognized from the claimed monitoring of the resistor temperature characteristic curve (R over T) of the temperature-dependent resistor. With such knowledge an incorrect control of the device, which is based on the temperature values delivered by the temperature-dependent resistor, can be prevented. This makes a significant contribution to the operational safety of the device, especially of the clothes dryer.

Advantageous embodiments of the claimed method are the subject matter of the subclaims which can be applied individually or in combination.

The above-mentioned object is further achieved by a method for operating a clothes dryer which also includes the claimed method for monitoring a temperature-dependent resistor. The two claimed methods are preferably implemented by a computer program which runs on a controller of the device, preferably of the clothes dryer. The computer program implements a further method of achieving said object. Finally the above-mentioned object is achieved by a clothes dryer with a heat source, with a temperature-dependent resistor and with a controller for controlling the heat source and for monitoring the temperature-dependent resistor, with the controller being embodied to execute the above-mentioned method. The advantages of these solutions correspond to the above advantages in relation to the claimed method for monitoring the temperature-dependent resistor.

BRIEF DESCRIPTION OF THE DRAWINGS

A total of two figures are enclosed with the description, with

DETAILED DESCRIPTION OF THE INVENTION

Figure 1:
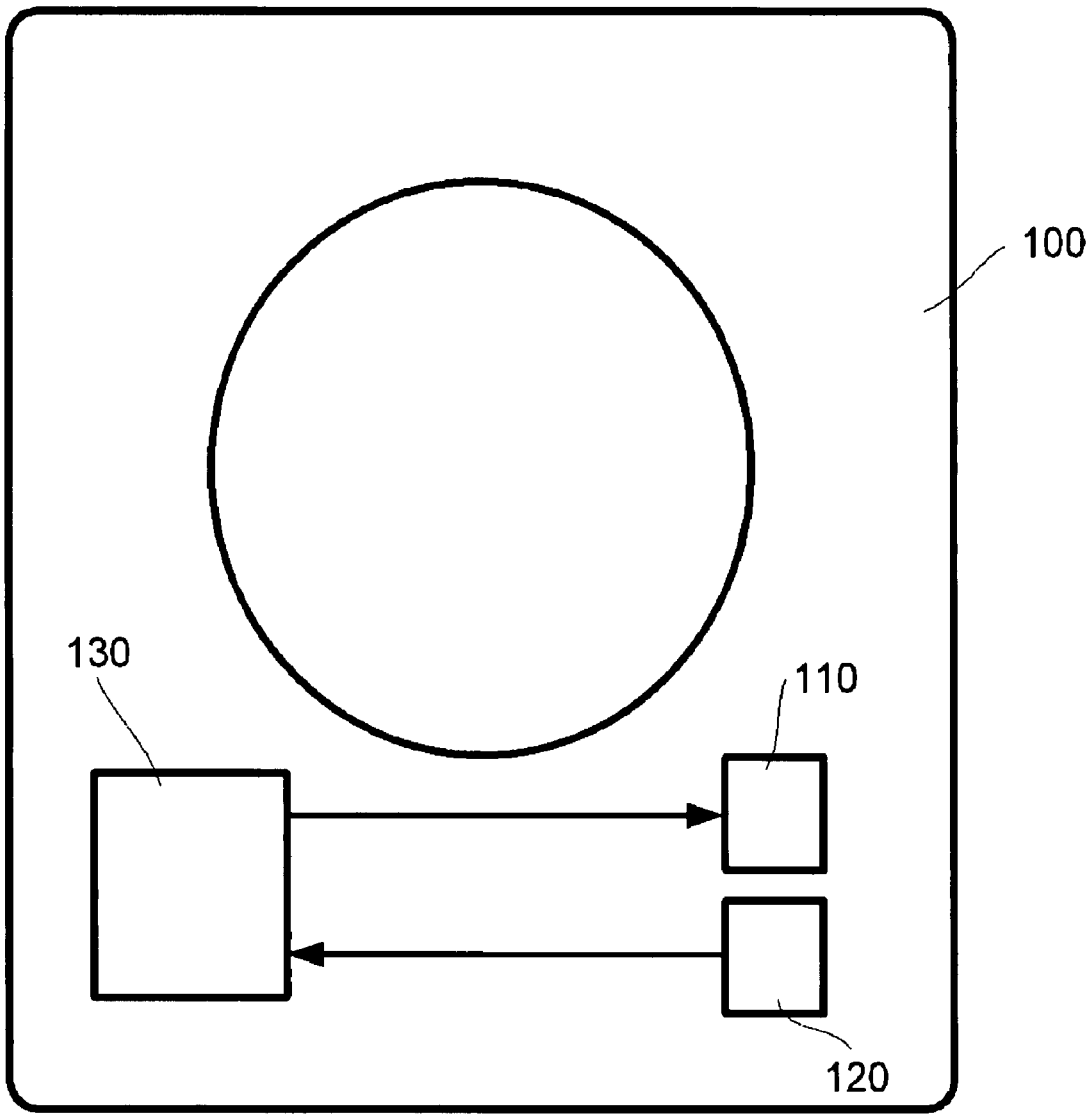
FIG. 1 showing an inventively embodied clothes dryer.

The invention will be described below in detail on the basis of exemplary embodiments which refer to the said figures. FIG. 1 shows an inventive clothes dryer 100 with a heat source 110 for heating up air which typically circulates in the clothes dryer to dry the clothes.

Furthermore the clothes dryer 100 includes a temperature-dependent resistor 120, especially a negative temperature coefficient NTC resistor for measuring the temperature of the flow of air in the clothes dryer and a controller 130 for controlling the heat source and monitoring the temperature-dependent resistor.

The controller 130 is embodied to execute the two inventive methods which are described below.

Figure 2:
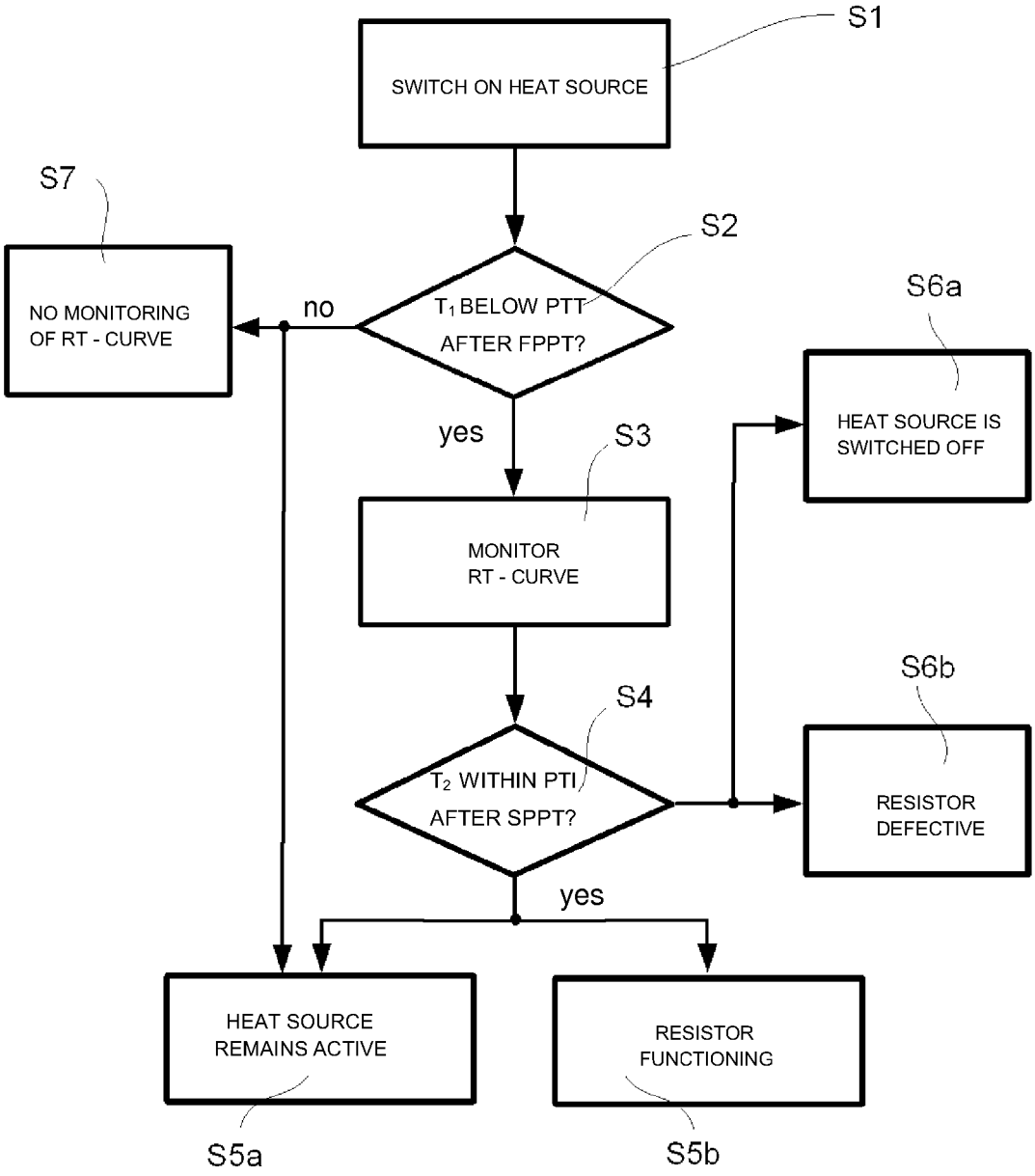
FIG. 2 showing the inventive method as schematic diagrams.

FIG. 2 illustrates an inventive method for monitoring the negative temperature coefficient (NTC) resistor 120 for measuring the temperature of the medium heated by the heat source, preferably of the air flow in the clothes dryer 100. In accordance with method step S1, the method provides for the heat source 110 to first be switched on. Subsequently in accordance with method step S2, there is provision for a check to be made as to whether the temperature ($T_1$) measured by the resistor 120 falls below a prespecified temperature threshold (PTT) value after a first prespecified period of time (FPPT) after the switching-on of the heat source.

If this is not the case, no inventive monitoring of a resistance-temperature (RT) characteristic curve of the resistor 120 is undertaken; (see method step S7). When this method is executed in a clothes dryer the drying process is continued in this case, which means that the heat source 110 remains switched on and continues to heat up the flow of air for drying the clothes in the clothes dryer; see method step S5*a*.

If however it is otherwise established in method step S2 that the measured temperature is below the prespecified temperature threshold, in accordance with method step S3 monitoring of the RT curve of the resistor 120 as regards a possible undesired shift or displacement over time is undertaken. This is undertaken inventively by a check initially being made in accordance with method step S4 as to whether the temperature ($T_2$) of the temperature-dependent resistor 120 measured after a second prespecified time (SPPT) after the first time has elapsed lies within a prespecified temperature interval (PTI). Should this be the case, it is established that the temperature-dependent resistor is still capable of functioning or that any change or shift of its RT characteristic curve which has taken place is still negligibly small; see method step S5*b*. In this case, if the method is executed in a clothes dryer, the heat source remains active for heating up the flow of air in the clothes dryer, see step S5*a*, and the clothes dryer is controlled taking into account temperature values delivered by the resistor assessed as capable of functioning.

Otherwise, if it is established in method step S4 that the temperature delivered by the temperature-dependent resistor 120 at the end of the second prespecified time lies outside the prespecified temperature interval, it is inventively established that the temperature-dependent resistor is defective; see method step S6*b*. In this case the heat source is switched off in accordance with method step S6*a* and a drying process is not continued in the clothes dryer.

The temperature threshold value, the first and second period of time as well as the temperature interval are to be suitably selected in each case.

The invention claimed is:

1. A method for monitoring a temperature-dependent resistor for measuring the temperature of an air flow heated up by a heat source in a clothes dryer, the method comprising:

switching on the heat source;

checking whether the temperature measured by the resistor after a first prespecified period of time after the switching-on of the heat source falls below a predetermined temperature threshold;

monitoring a resistance-temperature curve of the resistor if the temperature falls below the predetermined temperature threshold; and not monitoring the resistance-temperature curve of the resistor if the temperature does not fall below the predetermined temperature threshold.

2. The method as claimed in claim 1, wherein the temperature-dependent resistor includes a negative temperature coefficient resistor.

3. The method as claimed in claim 1, wherein the monitoring the resistance-temperature curve of the resistor if the temperature falls below the predetermined temperature threshold comprises:

checking whether the temperature measured by the resistor after a second prespecified period of time after the first prespecified period of time has elapsed lies within a prespecified temperature interval.

4. The method as claimed in claim 3, further comprising:

establishing that the temperature-dependent resistor is functioning if the temperature measured by the resistor after the second prespecified period of time after the first prespecified period of time has elapsed lies within the prespecified temperature interval; and establishing that the temperature-dependent resistor is defective if the temperature measured by the resistor after the second prespecified period of time after the first prespecified period of time has elapsed lies outside the prespecified temperature interval.

5. A method for operating a clothes dryer including a heat source for heating up an air flow in the clothes dryer for drying clothes and a temperature-dependent resistor that is being monitored, the method comprising:

switching on the heat source;

checking whether the temperature of the air flow measured by the resistor after a first prespecified period of time after the switching-on of the heat source falls below a predetermined temperature threshold;

monitoring a resistance-temperature curve of the resistor if the temperature falls below the predetermined temperature threshold;

not monitoring the resistance-temperature curve of the resistor if the temperature does not fall below the predetermined temperature threshold;

allowing the heat source to be switched on if one of the temperature measured by the resistor after the first prespecified period of time lies above the predetermined temperature threshold and the temperature measured by the resistor lies within a prespecified temperature interval after a second prespecified period of time after the first prespecified period of time has elapsed; and switching off the heat source if the temperature measured by the resistor lies outside the prespecified temperature interval after the second prespecified period of time has elapsed.

6. The method as claimed in claim 5, further comprising one of:

establishing that the temperature-dependent resistor is functioning if the temperature measured by the resistor after the second prespecified period of time after the first period of time has elapsed lies within the prespecified temperature interval; and establishing that the temperature-dependent resistor is faulty if the temperature measured by the resistor after the second prespecified period of time after the first period of time has elapsed lies outside the prespecified temperature interval.

7. The method as claimed in claim 5, wherein the temperature-dependent resistor includes a negative temperature coefficient resistor.

8. A clothes dryer comprising:

a heat source configured to heat up an air flow for drying clothes;

a temperature-dependent resistor configured to measure the temperature of the air flow; and a controller configured to:

switch on the heat source;

control the heat source;

monitor the temperature-dependent resistor;

check whether the temperature measured by the resistor after a first prespecified period of time after the switching-on of the heat source falls below a predetermined temperature threshold;

monitor a resistance-temperature curve of the resistor if the temperature falls below the predetermined temperature threshold; and not monitor the resistance-temperature curve of the resistor if the temperature does not fall below the predetermined temperature threshold.

9. The clothes dryer as claimed in claim 8, wherein the temperature-dependent resistor includes a negative temperature coefficient resistor.

10. The clothes dryer as claimed in claim 8, wherein, if the controller monitors the resistance-temperature curve of the resistor because the temperature falls below the predetermined temperature threshold, the controller is further configured to check whether the temperature measured by the resistor after a second prespecified period of time after the first prespecified period of time has elapsed lies within a prespecified temperature interval.

11. The clothes dryer as claimed in claim 10, wherein the controller is further configured to:

establish that the temperature-dependent resistor is functioning if the temperature measured by the resistor after the second prespecified period of time after the first prespecified period of time has elapsed lies within the prespecified temperature interval; and establish that the temperature-dependent resistor is faulty if the temperature measured by the resistor after the second prespecified period of time after the first prespecified period of time has elapsed lies outside the prespecified temperature interval.

12. The clothes dryer as claimed in claim 10, wherein the controller is further configured to:

allow the heat source to be switched on if one of the temperature measured by the resistor after the first prespecified period of time lies above the predetermined temperature threshold and the temperature measured by the resistor lies within a prespecified temperature interval after a second prespecified period of time after the first prespecified period of time has elapsed; and switch off the heat source if the temperature measured by the resistor lies outside the prespecified temperature interval after the second prespecified period of time has elapsed.

13. A method for determining whether a temperature-dependent resistor for measuring the temperature of the air inside a clothes dryer is defective, the method comprising:

activating a heating assembly to heat up the air inside the clothes dryer;

measuring a first temperature of the air with the temperature-dependent resistor at a first point in time after the activation of the heating assembly;

if the first temperature is lower than a predetermined temperature threshold, measuring a second temperature of the air with the temperature-dependent resistor at a second point in time after the first point in time;

if the second temperature is within a predetermined temperature range, leaving the heating assembly activated; and if the second temperature is outside the predetermined temperature range, deactivating the heating assembly and determining that the temperature-dependent resistor is defective.

14. The method as claimed in claim 13, further comprising leaving the heating assembly activated if the first temperature of the air measured with the temperature-dependent resistor at the first point in time is not lower than the predetermined temperature threshold.

* * * * *